United States Patent [19]

Munson

[11] Patent Number: 4,641,061

[45] Date of Patent: Feb. 3, 1987

[54] SOLID STATE BALLAST FOR GASEOUS DISCHARGE LAMPS

[75] Inventor: Robert D. Munson, Tupelo, Miss.

[73] Assignee: Emerson Electric Co., St. Louis, Mo.

[21] Appl. No.: 725,849

[22] Filed: Apr. 22, 1985

[51] Int. Cl.[4] ..... H05B 37/02

[52] U.S. Cl. ..... 315/210; 315/224; 315/244; 315/DIG. 7; 315/209 R; 315/226

[58] Field of Search ..... 315/210, 224, 226, 244, 315/DIG. 7, DIG. 2, DIG. 5, 209 R

[56] References Cited

U.S. PATENT DOCUMENTS

| | | | |
|---|---|---|---|
| 3,753,071 | 8/1973 | Engel | 315/201 |
| 4,045,711 | 8/1977 | Pitel | 315/239 |
| 4,053,813 | 10/1977 | Kornrumpf | 315/DIG. 7 |
| 4,525,648 | 6/1985 | DeBijl et al. | 315/224 |
| 4,544,863 | 10/1985 | Hashimoto | 315/244 |

*Primary Examiner*—Harold Dixon

*Attorney, Agent, or Firm*—Charles E. Markham

[57] ABSTRACT

A solid state ballast for starting and operating a plurality of fluorescent lamps comprises a plurality of parallel connected, series LC circuits each coupled by a capacitor to a lamp so that voltage existing across the series capacitors is applied across the lamps and driven by an inverter at a DC power source voltage and at a selected frequency high enough to develop a lamp starting voltage but substantially below their resonant frequency. After starting the resonant frequency of the LC circuits is reduced substantially below the selected frequency by the added capacitive reactances of the coupling capacitors whereby the destructive high voltage at the upper and lower resonances is avoided and the independent selection of the values of L and C and the coupling capacitors to control starting voltage and conduction after starting at the selected frequency is provided.

10 Claims, 1 Drawing Figure

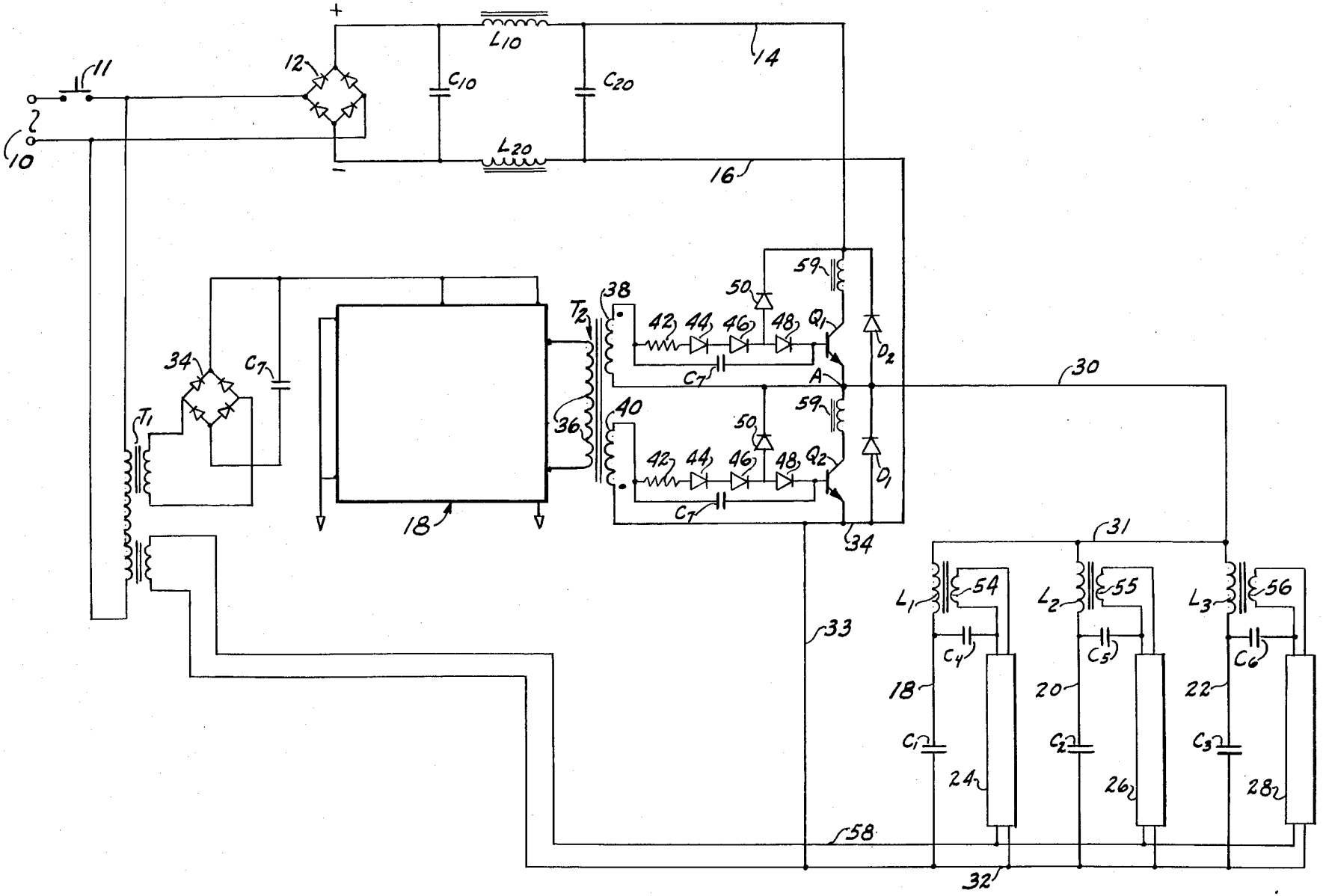
10
11
12
14
16
18
20
22
24
26
28
30
31
32
33
34
36
38
40
42
44
46
48
50
54
55
56
58
59
A
Q1
Q2
D1
D2
C1
C2
C3
C4
C5
C6
C7
C10
C20
L1
L2
L3
L10
L20
T1
T2
+
-

SOLID STATE BALLAST FOR GASEOUS DISCHARGE LAMPS

This invention relates generally to ballast circuits for starting and operating gaseous discharge lamps and particularly to a novel solid state ballast circuit for starting and operating one or more high intensity and relatively high wattage fluorescent lamps efficiently at high frequency energization.

There is a need for a lighting fixture suitable for ceiling mounted industrial service having the same lumen output per input watt as a high pressure 250 watt sodium vapor lamp without the objectionable features of sodium vapor lamps. Applicant has found that a lighting fixture having a plurality of relatively high wattage fluorescent lamps therein when started and operated efficiently at high frequency energization in the novel manner hereinafter disclosed will provide a softer, better distributed and substantially equivalent illumination per input watt as a high pressure sodium vapor lamp without the objectionable variations in color, glare or delay in full light output characteristic of sodium vapor lamps.

OBJECTS OF THE INVENTION

The primary object of the invention is to provide a generally new and improved solid state ballast for the rapid starting and operation of one or more high intensity, relatively high wattage fluorescent lamps efficiently at high frequency energization;

A further object is to capacitor couple a series LC circuit to a fluorescent lamp so as to apply the voltage existing across the series capacitor of the LC circuit across the lamp, to drive the LC circuit at a power source DC voltage and at a selected frequency substantially below its resonant frequency to develop an adequate higher sine wave starting voltage and in reducing the resonant frequency of the LC circuit substantially below the selected frequency after starting conduction through the lamp by the additional capacitive reactance of the coupling capacitor thereby avoiding destructive high voltages at resonance;

A further object is to select values of the inductor and capacitor of the series LC circuit in the preceding paragraph so as to develop a starting voltage when driven at an available line voltage and at a selected frequency substantially below their resonant frequency and in selecting the value of the coupling capacitor so as to reduce the resonant frequency of the circuit substantially below the selected frequency and suitably control conduction through the lamp after starting;

A further object is to connect a plurality of series LC circuits in parallel and capacitor coupling each to a fluorescent lamp;

A further object is to apply sufficient voltage across the fluorescent lamp filaments.

Further objects and advantages will become apparent when reading the following description and operation of a preferred embodiment.

SUMMARY

A commercial 60 hertz AC power source of 277 volts is full wave rectified and filtered to provide a DC power source of approximately 350 volts. Three parallel connected, series LC circuits are each coupled by a capacitor to a fluorescent lamp so as to shunt the voltage existing across the series capacitors of the LC circuits across the lamps. The parallel connected LC circuits are driven by an inverter at the DC power source voltage and at a selected frequency which is high enough to develop a starting voltage across the series capacitors to start conduction through the lamps but is yet substantially below the resonant frequency of the series LC circuits. After starting conduction through the lamps the LC circuits now include the added capacitive reactance of the coupling capacitors and the resonant frequency of the circuits is reduced to a frequency below the selected frequency. Whereby the selected frequency at which the series LC circuits are driven is intermediate of the higher and lower resonant frequencies thereby avoiding the excessively high destructive voltages which develop at the resonant frequencies. This arrangement permits independent control of starting voltage and lamp operation by selection of the values of the inductor and capacitor of the series LC circuits and the selection of the value of the coupling capacitor for different products of reactances.

A driving voltage at the selected frequency is applied to the LC circuits by the inverter and the LC circuits apply a sine wave voltage (open circuit voltage) to the lamps before starting and a distorted sine wave of lesser voltage thereto after starting. After starting current flow through the lamps is suitably limited by the impedance of the coupling capacitors at the selected frequency. The emitting filaments at one end of the lamps are inductively coupled to the inductors of the LC circuits and at their other ends are inductively coupled to the AC power source thereby to provide a constant suitable voltage across the lamp filaments. A separate commercially available integrated circuit including a conveniently adjustable oscillator circuit alternately pulses the inverter switches so as to drive the series LC circuits at a selected frequency is inductively coupled to the AC power source.

In the Drawing

The single FIGURE of the drawing is a diagrammatic illustration of a lighting fixture having a plurality of fluorescent lamps therein and a solid state ballast for the starting and operation thereof constructed in accordance with the present invention.

DESCRIPTION OF PREFERRED EMBODIMENT

Referring to the drawing, a 60 hertz AC power source 10 of 277 volts and including a line switch 11 is full wave rectified by a suitable bridge 12 and filtered by capacitors $C_{10}$ and $C_{20}$ and inductances $L_{10}$ and $L_{20}$ to provide a DC power source of approximately 350 volts across the leads 14 and 16 when switch 11 is closed. The value of capacitors $C_{10}$ and $C_{20}$ and inductances $L_{10}$ and $L_{20}$ are chosen to provide the highest power factor. An additional advantage of this arrangement is to shield the DC power source from radio frequency interference generated by the inverter to be described later.

Three series LC resonant circuits comprising inductances $L_1$, $L_2$ and $L_3$ and series connected capacitors $C_1$, $C_2$ and $C_3$ are connected in parallel across the DC power source by lead 14, inverter transistor $Q_1$ and leads 30, 31, 32, 33, 34 and 16. The LC circuits are driven one half cycle through this connecting circuit in one direction at DC power source voltage and at a selected frequency when transistor $Q_1$ is conducting and line switch 11 is closed. A node at point A connecting the emitter of $Q_1$ with lead 30 and a transistor $Q_2$ connecting point A to lead 34 completes a circuit for the return half cycle when capacitors $C_1$ to $C_3$ are discharging and inverter transistor $Q_2$ is conducting.

Each of the three series LC circuits is coupled by a capacitor to one end of an elongated double ended fluorescent lamp. The fluorescent lamps designated at 24, 26 and 28 are coupled to the LC circuits by capacitors $C_4$, $C_5$ and $C_6$. The coupling capacitors are directly connected to the series LC circuits between their inductors and capacitors so as to apply the voltage existing across their series LC capacitors to one end of the lamps. At their other ends the lamps are directly connected to the LC circuits by the lead 32. The value of the inductors and capacitors of the series LC circuits and the resistance of circuitry connecting them across the DC power source are such as to develop a sufficient lamp starting voltage across the series capacitors when driven at a selected frequency, which selected frequency is substantially below their resonant frequency. Also the values of the coupling capacitors $C_4$ to $C_6$ is such as to reduce the resonant frequency of the circuits after starting conduction through the lamps to a frequency substantially below the selected frequency and to suitably limit current flow through the lamps.

A commercially available integrated circuit is shown in block form at 18. The 1C18 circuit is manufactured by the Silicon General Corporation, catalog No. SG3525A. The 1C18 includes a conveniently adjustable oscillator circuit and a conveniently adjustable flip-flop circuit and generates alternate output pulses in square wave form at a selected frequency and at a selected pulse duration and therefore at a selected dead time period between alternate pulses. An independent low voltage DC power source is provided for the energization of 1C18. This DC power source comprises a voltage step-down transformer $T_1$ having a primary winding connected across the AC power source and a secondary winding the output of which is full wave rectified and filtered by a bridge 35 and a capacitor $C_7$ and suitably connected to the 1C18.

A transformer $T_2$ having a primary winding 36 is connected to the output terminals of 1C18 so as to receive the alternate output pulses of 1C18 at its opposite ends. Secondary windings 38 and 40 are inductively coupled to the primary winding 36 and have one end thereof connected to the bases of inverter transistors $Q_1$ and $Q_2$ respectively through series connected resistors 42 and diodes 44, 46 and 48 and parallel connected capacitors $C_7$. An additional diode 50 is connected between diodes 46 and 48 in the base circuits and the collectors of transistors $Q_1$ and $Q_2$. The other end of secondary winding 38 is connected to the lead 30 and the other end of secondary winding 40 is connected to the lead 34.

The components in the base circuits of transistors $Q_1$ and $Q_2$ in conjuction with the windings 38 and 40 protect and assist in rendering the transistors dependable and accurate high speed switches. Resistors 42 limit the current in the base circuit to a safe value and diodes 44, 46 and 48 clamp the voltage to prevent the transistors from going into deep saturation. The diodes 50 act to cut off the base voltage and current as the collector emitter voltage decreases at turn off and the capacitors $C_7$ couple the wave form of transformer $T_2$ directly to the bases of the transistors apart from the steady base drive for instant turn on of the transistors. Also windings 59 in the collectors of transistors $Q_1$ and $Q_2$ are inductively coupled to the secondary windings 38 and 40 respectively to provide a signal to the bases of the transistors via the windings 38 and 40 which signal is proportional to their collector currents thereby to assist in transistor turn on and turn off. Diodes $D_1$ and $D_2$ connected between leads 34 and 30 and between leads 30 and 14 provide a path for current flow in event transistors $Q_1$ and $Q_2$ are both turned off. The lamp emitting filaments (not shown) at the upper ends of the lamps 24, 26 and 28 are supplied a suitable voltage thereacross by windings 54, 55 and 56 which are inductively coupled to the inductances $L_1$, $L_2$ and $L_3$ of the LC circuits. The lamp emitting filaments (not shown) at the lower ends of the lamps are supplied a suitable voltage thereacross by transformer $T_1$ having a secondary winding connected across the lamp filaments by leads 32 and 58.

OPERATION

The oscillator of 1C18 is adjusted so that the frequency of its alternate output pulses will result in the alternate conduction of inverter transistors $Q_1$ and $Q_2$ at a selected frequency. Also the flip-flop circuit of 1C18 is adjusted so as to provide sufficient dead time between alternate pulses at the selected frequency to insure the turn off of one of the inverter transistors before the turn on of the other. A selected frequency, in the order of 22K Hertz, being sufficiently high to generate a voltage across capacitors $C_1$, $C_2$ and $C_3$ of the series LC circuits which is adequate to start conduction through the lamps but is yet substantially below the resonant frequency of the series LC circuits before starting. When line switch 11 is closed and transistor $Q_1$ is conducting the parallel connected series LC circuits will be driven one half cycle in one direction at the selected frequency and at the DC power source voltage through lead 14, transistor $Q_1$ and leads 30, 31, 32, 33, 34 and 16 across the DC power source and in a reverse half cycle by discharge of the series LC capacitors when $Q_2$ is conducting.

After starting conduction through the lamps the reactances of the coupling capacitors $C_4$, $C_5$ and $C_6$ adds impedance to the series LC circuits resulting in a reduction in their resonant frequency to a point substantially below the selected frequency at which the series LC circuits are driven. In other words the selected frequency is intermediate of the higher resonant frequency before starting and the lower resonant frequency after starting. This arrangement avoids the high destructive voltage developed at resonance while permitting the selection of values of L and C of the series LC resonant circuits which will develop a sufficient starting voltage at a frequency substantially below their resonant frequency. Also this arrangement, which is a salient feature of this invention, permits the independent selection of the values of L and C of the series LC circuits at one product of reactances to control open circuit, lamp starting voltage and independent selection of the value of the coupling capacitors at a substantially different product of reactances to control operation of the lamps after starting.

In a prototype solid state ballast and its successful use in starting and operating three 96 inch long fluorescent lamps as described the values of the inductors and capacitors of the series LC circuits were 0.004 henries and 0.015 MFD respectively, the coupling capacitors 0.047 MFD and the selected frequency approximately 22K hertz.

While the solid state ballast described has particular weight and bulk advantage over a transformer type ballast when employed to start and operate a plurality of high intensity, high wattage fluorescent lamps to jointly provide a high level of illumination it will be understood that the described ballast may be employed to start and operate a single gaseous discharge lamp of any input wattage.

I claim:

1. A solid state ballast for starting and operating a gaseous discharge lamp comprising a D.C. power source voltage a series LC circuit, a coupling capacitor coupling said lamp to said series LC circuit so as to apply the voltage existing across said series capacitor across said lamp, inverter means for driving said series LC circuit at said DC power source voltage and at a selected frequency, said selected frequency being sufficiently high to develop a voltage across said series capacitor adequate to start conduction through said lamp but being substantially below the resonant frequency of said LC circuit, and the value of said coupling capacitor being such that its added reactance after conduction through said lamp is started lowers the resonant frequency of said series LC circuit substantially below said selected frequency.

2. The solid state ballast claimed in claim 1 in which said gaseous discharge lamp is a fluorescent lamp including a pair of emitting filaments and which includes means for applying a suitable AC voltage across said filaments.

3. The solid state ballast claimed in claim 1 in which a plurality of parallel connected, series LC circuits are each capacitor coupled to a gaseous discharge lamp and driven by said inverter at said DC power source voltage and at said selected frequency.

4. The Solid state ballast claimed in claim 2 in which said DC power source is provided by rectification and filtering of an AC power source, and in which at least one of said of lamp filaments is inductively coupled to said AC power source.

5. The solid state ballast claimed in claim 2 in which at least one of said pair of lamp filaments is inductively coupled to the inductance coil of said series LC circuit.

6. The solid state ballast claimed in claim 1 in which said value of said coupling capacitor is also such as to suitably control conduction through said lamp at said selected frequency.

7. The solid state ballast claimed in claim 1 in which said inverter comprises a pair of transistors alternately pulsed to conduction at the selected frequency by a commercially available integrated circuit including an oscillator circuit the frequency of which is conveniently variable.

8. A solid state ballast for starting and operating a plurality of fluorescent lamps efficiently at high frequency comprising a DC power source voltage, a plurality of series LC circuits connected in parallel and each coupled by a capacitor to a lamp so as to shunt the voltage existing across the series capacitor across the lamp, inverter means driving said LC circuits at said DC power source voltage and at a selected frequency, the values of the inductors and capacitors of said LC circuits and the resistance of circuitry connecting them across said DC power source being such that their resonant frequency is substantially higher than said selected frequency and said selected frequency being such that an adequate lamp starting voltage is developed across said series capacitors when said LC circuits are driven at said power source voltage and at said selected frequency, and the values of said coupling capacitors being such that their added capacitive reactance after conduction through said lamp is started as to reduce the resonant frequency of said LC circuits substantially below said selected frequency.

9. The solid state ballast claimed in claim 8 in which said fluorescent lamps each include a pair of emitting filaments and in which means for constantly applying a suitable voltage thereacross is provided.

10. The solid state ballast claimed in claim 8 in which the values of said coupling capacitors are such as to result in optimum conduction and therefore optimum lumen output of said lamps.

* * * * *